United States Patent [19]

Dussan V. et al.

[11] Patent Number: 4,890,487

[45] Date of Patent: Jan. 2, 1990

[54] METHOD FOR DETERMINING HORIZONTAL AND/OR VERTICAL PERMEABILITY OF A SUBSURFACE EARTH FORMATION

[75] Inventors: Elizabeth B. Dussan V., Ridgefield; Yogeshwar Sharma, Danbury, both of Conn.

[73] Assignee: Schlumberger Technology Corporation, New York, N.Y.

[21] Appl. No.: 35,563

[22] Filed: Apr. 7, 1987

[51] Int. Cl.[4] ..... E21B 49/00

[52] U.S. Cl. ..... 73/152; 73/155; 364/422

[58] Field of Search ..... 73/155, 152; 364/422; 166/250; 250/270

[56] References Cited

U.S. PATENT DOCUMENTS

| | | | |
|---|---|---|---|
| 3,771,360 | 11/1973 | Prats | 73/155 |
| 4,353,249 | 10/1982 | Lagus et al. | 73/155 |
| 4,495,805 | 1/1985 | Dowling et al. | 73/155 |
| 4,742,459 | 5/1988 | Lasseter | 364/422 |

FOREIGN PATENT DOCUMENTS

0217684A1 4/1987 European Pat. Off. .

OTHER PUBLICATIONS

Goodier, J. N. and Hodge, P. G., "*Elasticity and Plasticity*", John Wiley & Sons, Inc., pp. 29–35 (1958).

Stewart, G. and Wittmann, M., "*Interpretation of the Pressure Response of the Repeat Formation Tester*", Society of Petroleum Engineers of AIME, (SPE 8362), Sep. 23–26, 1979.

*Primary Examiner*—Eugene R. LaRoche
*Assistant Examiner*—Seung Ham
*Attorney, Agent, or Firm*—Clifford L. Tager; David G. Coker

[57] ABSTRACT

Pressure and flow measurements made during extraction of fluid samples from a subsurface earth formation using a borehole logging tool having a single extraction probe are analyzed to derive separate values for both horizontal and vertical formation permeability. Build-up measurements are used to derive the slope of variation of formation pressure with respect to a spherical time function, and this value is incorporated in an expression for a dimensionless variable relating pressure, flowrate, porosity, compressibility and probe radius. The resulting value of the dimensionless constant provides an index into a look-up table obtained by a new analysis of the fluid dynamics in the immediate vicinity of the probe for an anisotropic formation. The table gives values for two or more dimensionless variables from which the permeability values are derived.

52 Claims, 6 Drawing Sheets

TABLE 1

| $K_H$ | $K_V$ | $k_H/k_V$ | $S_D$ |
|---|---|---|---|
| 1.5708 | 1.5708 | 1.0 | 0.2580 |
| 1.8541 | 0.9270 | 2.0 | 0.3138 |
| 2.0290 | 0.6763 | 3.0 | 0.3592 |
| 2.1565 | 0.5391 | 4.0 | 0.3988 |
| 2.2572 | 0.4514 | 5.0 | 0.4348 |
| 2.3405 | 0.3901 | 6.0 | 0.4680 |
| 2.4116 | 0.3445 | 7.0 | 0.4991 |
| 2.4736 | 0.3092 | 8.0 | 0.5286 |
| 2.5286 | 0.2810 | 9.0 | 0.5567 |
| 2.5781 | 0.2578 | 10.0 | 0.5836 |
| 2.6230 | 0.2385 | 11.0 | 0.6095 |
| 2.6642 | 0.2220 | 12.0 | 0.6346 |
| 2.7022 | 0.2079 | 13.0 | 0.6589 |
| 2.7374 | 0.1955 | 14.0 | 0.6825 |
| 2.7704 | 0.1847 | 15.0 | 0.7055 |
| 2.8012 | 0.1751 | 16.0 | 0.7279 |
| 2.8302 | 0.1665 | 17.0 | 0.7499 |
| 2.8577 | 0.1588 | 18.0 | 0.7713 |
| 2.8837 | 0.1518 | 19.0 | 0.7924 |
| 2.9083 | 0.1454 | 20.0 | 0.8130 |
| 2.9319 | 0.1396 | 21.0 | 0.8333 |
| 2.9543 | 0.1343 | 22.0 | 0.8532 |
| 2.9758 | 0.1294 | 23.0 | 0.8728 |
| 2.9964 | 0.1248 | 24.0 | 0.8921 |
| 3.0161 | 0.1206 | 25.0 | 0.9112 |
| 3.0351 | 0.1167 | 26.0 | 0.9299 |
| 3.0534 | 0.1131 | 27.0 | 0.9484 |
| 3.0711 | 0.1097 | 28.0 | 0.9667 |
| 3.0881 | 0.1065 | 29.0 | 0.9847 |
| 3.1046 | 0.1035 | 30.0 | 1.0026 |
| 3.1205 | 0.1007 | 31.0 | 1.0202 |
| 3.1360 | 0.0980 | 32.0 | 1.0376 |
| 3.1510 | 0.0955 | 33.0 | 1.0548 |
| 3.1655 | 0.0931 | 34.0 | 1.0719 |
| 3.1797 | 0.0908 | 35.0 | 1.0887 |
| 3.1934 | 0.0887 | 36.0 | 1.1055 |
| 3.2068 | 0.0867 | 37.0 | 1.1220 |
| 3.2198 | 0.0847 | 38.0 | 1.1384 |
| 3.2325 | 0.0829 | 39.0 | 1.1547 |
| 3.2449 | 0.0811 | 40.0 | 1.1708 |
| 3.2569 | 0.0794 | 41.0 | 1.1867 |
| 3.2687 | 0.0778 | 42.0 | 1.2026 |
| 3.2802 | 0.0763 | 43.0 | 1.2183 |
| 3.2915 | 0.0748 | 44.0 | 1.2339 |
| 3.3025 | 0.0734 | 45.0 | 1.2494 |
| 3.3133 | 0.0720 | 46.0 | 1.2647 |
| 3.3238 | 0.0707 | 47.0 | 1.2799 |
| 3.3341 | 0.0695 | 48.0 | 1.2951 |
| 3.3442 | 0.0682 | 49.0 | 1.3101 |
| 3.3541 | 0.0671 | 50.0 | 1.3250 |

FIGURE 3a

TABLE 1 (continued)

| $K_H$ | $K_V$ | $k_H/k_V$ | $S_D$ |
|---|---|---|---|
| 3.3639 | 0.0660 | 51.0 | 1.3399 |
| 3.3734 | 0.0649 | 52.0 | 1.3546 |
| 3.3827 | 0.0638 | 53.0 | 1.3692 |
| 3.3919 | 0.0628 | 54.0 | 1.3838 |
| 3.4009 | 0.0618 | 55.0 | 1.3982 |
| 3.4098 | 0.0609 | 56.0 | 1.4126 |
| 3.4185 | 0.0600 | 57.0 | 1.4268 |
| 3.4270 | 0.0591 | 58.0 | 1.4410 |
| 3.4354 | 0.0582 | 59.0 | 1.4552 |
| 3.4437 | 0.0574 | 60.0 | 1.4692 |
| 3.4518 | 0.0566 | 61.0 | 1.4831 |
| 3.4598 | 0.0558 | 62.0 | 1.4970 |
| 3.4677 | 0.0550 | 63.0 | 1.5108 |
| 3.4754 | 0.0543 | 64.0 | 1.5246 |
| 3.4831 | 0.0536 | 65.0 | 1.5382 |
| 3.4906 | 0.0529 | 66.0 | 1.5518 |
| 3.4980 | 0.0522 | 67.0 | 1.5654 |
| 3.5053 | 0.0515 | 68.0 | 1.5788 |
| 3.5125 | 0.0509 | 69.0 | 1.5922 |
| 3.5196 | 0.0503 | 70.0 | 1.6056 |
| 3.5266 | 0.0497 | 71.0 | 1.6188 |
| 3.5335 | 0.0491 | 72.0 | 1.6320 |
| 3.5403 | 0.0485 | 73.0 | 1.6452 |
| 3.5470 | 0.0479 | 74.0 | 1.6583 |
| 3.5536 | 0.0474 | 75.0 | 1.6713 |
| 3.5601 | 0.0468 | 76.0 | 1.6843 |
| 3.5666 | 0.0463 | 77.0 | 1.6972 |
| 3.5729 | 0.0458 | 78.0 | 1.7101 |
| 3.5792 | 0.0453 | 79.0 | 1.7229 |
| 3.5854 | 0.0448 | 80.0 | 1.7357 |
| 3.5915 | 0.0443 | 81.0 | 1.7484 |
| 3.5976 | 0.0439 | 82.0 | 1.7611 |
| 3.6036 | 0.0434 | 83.0 | 1.7737 |
| 3.6095 | 0.0430 | 84.0 | 1.7862 |
| 3.6153 | 0.0425 | 85.0 | 1.7988 |
| 3.6211 | 0.0421 | 86.0 | 1.8112 |
| 3.6268 | 0.0417 | 87.0 | 1.8236 |
| 3.6325 | 0.0413 | 88.0 | 1.8360 |
| 3.6380 | 0.0409 | 89.0 | 1.8484 |
| 3.6436 | 0.0405 | 90.0 | 1.8606 |
| 3.6490 | 0.0401 | 91.0 | 1.8729 |
| 3.6544 | 0.0397 | 92.0 | 1.8851 |
| 3.6598 | 0.0394 | 93.0 | 1.8972 |
| 3.6651 | 0.0390 | 94.0 | 1.9094 |
| 3.6703 | 0.0386 | 95.0 | 1.9214 |
| 3.6755 | 0.0383 | 96.0 | 1.9335 |
| 3.6806 | 0.0379 | 97.0 | 1.9455 |
| 3.6856 | 0.0376 | 98.0 | 1.9574 |
| 3.6907 | 0.0373 | 99.0 | 1.9693 |
| 3.6956 | 0.0370 | 100.0 | 1.9812 |

FIGURE 3b

TABLE 1 (continued)

| $K_H$ | $K_V$ | $k_H/k_V$ | $S_D$ |
|---|---|---|---|
| 3.7006 | 0.0366 | 101.0 | 1.9931 |
| 3.7054 | 0.0363 | 102.0 | 2.0049 |
| 3.7103 | 0.0360 | 103.0 | 2.0166 |
| 3.7150 | 0.0357 | 104.0 | 2.0284 |
| 3.7198 | 0.0354 | 105.0 | 2.0401 |
| 3.7245 | 0.0351 | 106.0 | 2.0517 |
| 3.7291 | 0.0349 | 107.0 | 2.0633 |
| 3.7337 | 0.0346 | 108.0 | 2.0749 |
| 3.7383 | 0.0343 | 109.0 | 2.0865 |
| 3.7428 | 0.0340 | 110.0 | 2.0980 |
| 3.7473 | 0.0338 | 111.0 | 2.1095 |
| 3.7517 | 0.0335 | 112.0 | 2.1210 |
| 3.7561 | 0.0332 | 113.0 | 2.1324 |
| 3.7605 | 0.0330 | 114.0 | 2.1438 |
| 3.7648 | 0.0327 | 115.0 | 2.1551 |
| 3.7691 | 0.0325 | 116.0 | 2.1665 |
| 3.7733 | 0.0323 | 117.0 | 2.1778 |
| 3.7775 | 0.0320 | 118.0 | 2.1891 |
| 3.7817 | 0.0318 | 119.0 | 2.2003 |
| 3.7859 | 0.0315 | 120.0 | 2.2115 |
| 3.7900 | 0.0313 | 121.0 | 2.2227 |
| 3.7940 | 0.0311 | 122.0 | 2.2338 |
| 3.7981 | 0.0309 | 123.0 | 2.2450 |
| 3.8021 | 0.0307 | 124.0 | 2.2561 |
| 3.8061 | 0.0304 | 125.0 | 2.2671 |
| 3.8100 | 0.0302 | 126.0 | 2.2782 |
| 3.8139 | 0.0300 | 127.0 | 2.2892 |
| 3.8178 | 0.0298 | 128.0 | 2.3002 |
| 3.8217 | 0.0296 | 129.0 | 2.3111 |
| 3.8255 | 0.0294 | 130.0 | 2.3221 |
| 3.8293 | 0.0292 | 131.0 | 2.3330 |
| 3.8331 | 0.0290 | 132.0 | 2.3439 |
| 3.8368 | 0.0288 | 133.0 | 2.3547 |
| 3.8405 | 0.0287 | 134.0 | 2.3656 |
| 3.8442 | 0.0285 | 135.0 | 2.3764 |
| 3.8479 | 0.0283 | 136.0 | 2.3871 |
| 3.8515 | 0.0281 | 137.0 | 2.3979 |
| 3.8551 | 0.0279 | 138.0 | 2.4086 |
| 3.8587 | 0.0278 | 139.0 | 2.4193 |
| 3.8622 | 0.0276 | 140.0 | 2.4300 |
| 3.8658 | 0.0274 | 141.0 | 2.4407 |
| 3.8693 | 0.0272 | 142.0 | 2.4513 |
| 3.8727 | 0.0271 | 143.0 | 2.4619 |
| 3.8762 | 0.0269 | 144.0 | 2.4725 |
| 3.8796 | 0.0268 | 145.0 | 2.4831 |
| 3.8830 | 0.0266 | 146.0 | 2.4937 |
| 3.8864 | 0.0264 | 147.0 | 2.5042 |
| 3.8898 | 0.0263 | 148.0 | 2.5147 |
| 3.8931 | 0.0261 | 149.0 | 2.5252 |
| 3.8964 | 0.0260 | 150.0 | 2.5356 |

FIGURE 3c

METHOD FOR DETERMINING HORIZONTAL AND/OR VERTICAL PERMEABILITY OF A SUBSURFACE EARTH FORMATION

BACKGROUND OF THE INVENTION

This invention relates to methods for determining the permeability of a subsurface earth formation traversed by a borehole.

The permeability of an earth formation containing valuable resources such as liquid or gaseous hydrocarbons is a parameter of major significance to the economic production of that resource. These resources can be located by borehole logging to measure for example the resistivity and porosity of the formation in the vicinity of a borehole traversing the formation. Such measurements enable porous zones to be identified and their water saturation (percentage of pore space occupied by water) to be estimated. A value of water saturation significantly less than unity is taken as being indicative of the presence of hydrocarbons, and may also be used to estimate their quantity. However, this information alone is not necessarily adequate for a decision on whether the hydrocarbons are economically producible. The pore spaces containing the hydrocarbons may be isolated or only slightly interconnected, in which case the hydrocarbons will be unable to flow through the formation to the borehole. The ease with which fluids can flow through the formation, or permeability, should preferably exceed some threshold value to assure the economic feasibility of turning the borehole into a producing well. The threshold value may vary depending on such characteristics as the viscosity (in the case of oil): for example a highly viscous oil will not flow easily in low permeability conditions and if water injection is to be used to promote production there may be a risk of premature water breakthrough at the producing well.

The permeability of a formation is not necessarily isotropic. In particular, the permeability for fluid flow in a generally horizontal direction may be different from (and typically greater than) the value for flow in a generally vertical direction. This may arise for example from the effects of interfaces between adjacent layers making up a formation, or from anisotropic orientation of formation particles such as sand grains. Where there is a strong degree of permeability anisotropy it is important to distinguish the presence and degree of the anisotropy, to avoid using a value dominated by the permeability in only one direction as a misleading indication of the permeability in all directions.

Present techniques for evaluating formation permeability by borehole logging are somewhat limited. One tool that has gained commercial acceptance provides for repeat formation testing and is described for example in U.S. Pat. Nos. 3,780,575 to Urbanosky and 3,952,588 to Whitten, both assigned to the assignee of the present application. This tool includes the capability for repeatedly taking two successive samples at different flowrates from a formation via a probe inserted into a borehole wall. The fluid pressure is monitored and recorded throughout the sample extraction period and for a period of time thereafter. Analysis of the pressure variations with time during the sample extractions (draw-down) and the subsequent return to initial conditions (build-up) enables a value for formation permeability to be derived both for the draw-down and build-up phases of operation - see 'RFT Essentials of pressure test interpretation' by Schlumberger, 1981.

However, the analysis assumes a homogeneous formation, and yields a single, 'spherical' permeability value. Only in some cases can the analysis yield separate values for horizontal and vertical permeabilities, and then only with the incorporation of data from other logging tools or from core analysis. Up to the present it has been assumed that it is not possible to derive separate horizontal and vertical permeability values solely from the measurements provided by the single probe type of tool described in the above-mentioned U.S. patents. Furthermore, it is frequently found that the two values of spherical permeability obtained from the draw-down and the build-up measurements may differ by an order of magnitude. This leads to uncertainty as to which value, if either, should be taken as representative of the formation permeability for purposes of production evaluation.

It is an object of this invention to provide a more accurate method of determining permeability of earth formations by analysis of formation flow tests.

It is another object of this invention to provide a method of determining horizontal and/or vertical permeability of earth formations by analysis of formation flow tests.

SUMMARY OF THE INVENTION

The inventors hereof have discovered that, contrary to the accepted wisdom in this art, it is possible to derive individual values of horizontal and vertical formation permeabilities from pressure and flow measurements made via a single probe inserted into the formation. This is accomplished by using, in place of the conventional relationship describing the fluid behavior during draw-down, the following equation $$P_f - P_i = (Q_i \mu / 2\pi r p k_H) F[\pi/2, \sqrt{(1 - k_V/k_H)}] \text{ for } i = 1,2 \quad (1)$$

where $P_f$ represents pressure of the undisturbed formation;

$P_i$ represents pressure at the end of draw-down period i;

$Q_i$ represents volumetric flow rate during draw-down period i;

$\mu$ represents dynamic viscosity of the formation fluid;

rp represents the probe aperture radius;

$k_H$ represents horizontal formation permeability;

$k_V$ represents vertical formation permeability; and

F denotes the complete elliptic integral of the first kind.

This equation has been derived by the inventors as a result of a correct analysis of the fluid dynamics in the formation in the immediate vicinity of the probe for the case of an anisotropic formation. In particular the inventors have formulated the following mixed boundary-value problem as a definition of the fluid dynamics involved:

$$k_V \partial^2 P/\partial z^2 + k_H[\partial^2 P/\partial x^2 + \partial^2 P/\partial y^2] = 0$$

$$P = P_P \text{ for } x^2 + z^2 \leqq rp^2 \text{ and } y = 0$$

$$\partial P/\partial y = 0 \text{ for } x^2 + z^2 \geqq rp^2 \text{ and } y = 0$$

$$P \rightarrow P_f \text{ as } x^2 + y^2 + z^2 \rightarrow \infty \text{ and } y \geqq 0$$

where $P_P$ denotes the pressure at the probe;

the surface $y=0$ denotes the wall of the wellbore and the formation is located at $y>0$;

$k_H$ denotes the formation permeabilities in the x and y directions; and $k_V$ denotes the formation permeability in the z direction. Furthermore the inventors have succeeded in identifying the solution to the above-stated mixed boundary-value problem, and thereby evaluated volumetric flow rate Q according to the equation $$Q=+k_H/\mu\int_{A_p}\partial P/\partial y|_{y=0}dxdz$$

where $A_p$ denotes the surface of the probe in contact with the formation.

According to one aspect of this invention there is provided a method for determining permeability of an earth formation traversed by a borehole, in which signals are derived, by formation flow tests, representative of formation pressure after (build-up) flow of formation fluid via a probe extending into the formation. These signals are used in deriving a signal representative of formation permeability in accordance with equation (1) above, and a tangible record of this signal representative of formation permeability is produced.

According to another aspect of this invention a method for determining permeability of an earth formation traversed by a borehole includes deriving signals representative of formation pressure after flow of formation fluid via a probe extending into the formation. A function $S_D$ is evaluated upon the basis of these signals, $S_D$ being defined by the equivalence $$S_D=2Q_1m^2/\Phi c_t r_P^3(P_f-P_1)^3$$

where $Q_1$ represents volumetric flow rate;

$\Phi$ represents formation bulk porosity;

$c_t$ represents total compressibility;

$r_P$ represents the probe aperture radius;

$P_f$ represents pressure of the undisturbed formation;

$P_1$ represents pressure at the end of the first draw-down of fluids from the formation; and m represents the quantity $(Q_1\mu/4\pi k_S)\sqrt{(\Phi\mu c_t/\pi k_S)}$; where $\mu$ represents dynamic viscosity of the formation fluid; and $k_S$ represents formation spherical permeability $(k_H^2k_V)^{\frac{1}{3}}$, where $k_H$ represents horizontal formation permeability and $k_V$ represents vertical formation permeability.

Typically m is determined from the variation of pressure with time after flow of formation fluid, that is during build-up, and in particular from the slope of a straight line approximation to the pressure variation with respect to a spherical time function. A value is then derived for at least one of functions $K_H$ and $K_V$ representative of formation permeability, in accordance with the derived value of $S_D$ and the simultaneous equations $$K_H=F[\pi/2,\sqrt{(1-1/S_DK_{H3})}]K_V=1/S_DK_{H2}$$

where F denotes the complete elliptic integral of the first kind; and a tangible record of formation permeability in accordance with the derived value of permeability function $K_H$ and/or $K_V$ is produced.

According to another aspect of this invention a method for determining permeability of an earth formation traversed by a borehole includes deriving signals representative of formation pressure after flow of formation fluid via a probe extending into the formation. These signals are used to derive the value of a function $S_D$ defined by the equivalence $$S_D=2Q_1m^2/\Phi c_t r_P^3(P_f-P_1)^3;$$

A value for at least one of functions $K_H$ and $K_V$ representative of formation permeability is obtained from Table 1 herein in accordance with the derived value of $S_D$, and a tangible record of formation permeability in accordance with the derived value of permeability function $K_H$ and/or $K_V$ is produced.

In the case of highly permeable formations it is sometimes found to be impracticable to measure the pressure variation properly during build-up. This precludes the derivation of a value for the slope m of this variation with respect to the spherical time function, so $S_D$ cannot be determined. Nonetheless, the present invention makes possible an estimate of the likely range of formation permeabilities, based on a value for the formation anisotropy. Thus, according to a further aspect of the invention, a method for estimating permeability of an earth formation traversed by a borehole comprises deriving signals representative of formation pressure after flow of formation fluid via a probe extending into the formation; estimating a value of formation anisotropy; deriving a value for at least one of functions $K_H$ and $K_V$ representative of formation permeability in accordance with that estimated value of formation anisotropy and in accordance with the relationships $$K_H=F[\pi/2,\sqrt{(1-1/S_DK_{H3})}]K_V=1/S_DK_{H2}$$

where

F denotes the complete elliptic integral of the first kind; and $S_D$ is a constant;

and generating a tangible record of estimated formation permeability in accordance with the derived value of permeability function $K_H$ and/or $K_V$. Typically upper and lower bounds of formation anisotropy are estimated, and corresponding upper and lower bounds of estimated formation permeability are generated.

According to another aspect of the invention there is provided a method for estimating permeability of an earth formation traversed by a borehole comprising deriving signals representative of formation pressure after flow of formation fluid via a probe extending into the formation; estimating a value of formation anisotropy; deriving a value for at least one of functions $K_H$ and $K_V$ representative of formation permeability from Table 1 in accordance with that estimated value of formation anisotropy; and generating a tangible record of estimated formation permeability in accordance with the derived permeability function value.

As an incidental result of the investigations leading to the present invention, the inventors hereof have discovered that if the horizontal permeability of an anisotropic formation is greater than the vertical permeability, as is almost always the case, then the permeability derived from draw-down measurements should be greater than the spherical (build-up) permeability. This is indeed observed to be the case, lending support to the validity of the analysis embodied in the present invention. This observation also indicates that the significant differences previously noted in the permeability values hitherto obtained from draw-down and build-up measurements do not necessarily mean that the use of these measurements in the derivation of permeability values is an unreliable technique.

BRIEF DESCRIPTION OF THE DRAWINGS

Additional objects and features of the invention will become more apparent upon consideration of the following detailed description of the invention, reference being had to the accompanying drawings in which:

FIGS. 3*a* to 3*c* show a look-up table for use in a method in accordance with this invention.

DETAILED DESCRIPTION

Figure 1:
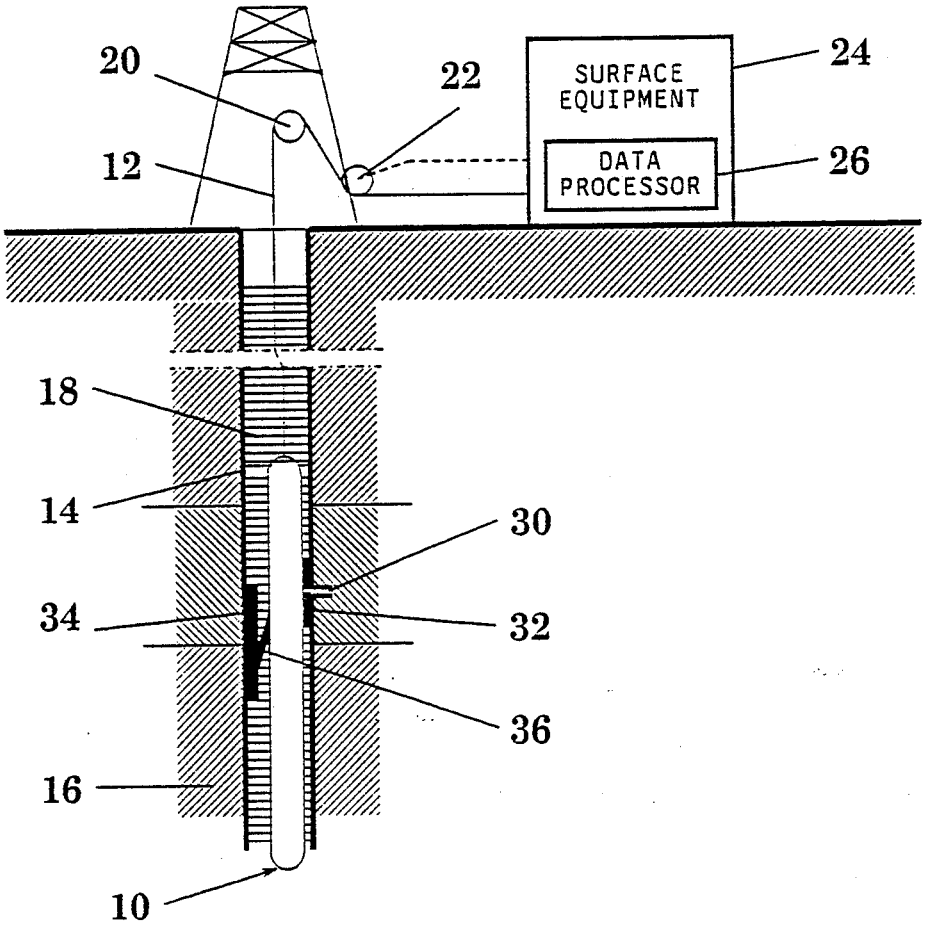
FIG. 1 is a schematic diagram of a borehole logging operation for collecting data for use in accordance with this invention.

Referring to FIG. 1, an elongate logging tool or sonde 10 is suspended on an armored communication cable 12 in a borehole 14 penetrating an earth formation 16. The borehole 14 is filled with liquid 18 such as drilling mud used to stabilize the borehole wall and prevent escape of formation fluids up the borehole. The tool 10 is moved in the borehole 14 by paying the cable 12 out and reeling it back in over a sheave wheel 20 and a depth gauge 22 by means of a winch forming part of a surface equipment 24. Usually the logging measurements are actually made while the tool 10 is being raised back up the borehole 14, although in certain circumstances they may additionally or alternatively be made on the way down. The depth gauge 22 measures displacement of the cable 12 over the sheave wheel 20 and thus the depth of the tool 10 in the borehole 14.

The tool 10 is generally as described in, for example, the aforementioned U.S. Pat. Nos. 3,780,575 to Urbanosky and 3,952,588 to Whitten which are incorporated herein by reference. In particular, the tool includes a probe 30 which is extendable into the formation 16 and a packer 32 which surrounds this probe and can be pushed against the formation 16 to seal the probe from direct communication with the borehole liquid 18. The tool 10 is braced by a back-up pad 34 mounted on a hydraulically extendable arm 36 diametrically opposite the probe 30, to prevent motion relative to the formation 16 when the probe is extended. The tool 10 also includes two sample chambers connected via valves to the probe 30, together with pressure gauges and flow meters to monitor the flow conditions of fluids extracted from the formation 16 via the probe 30. As these features are fully described in the abovementioned patent specifications they have been omitted from the drawings and will not be described further, for the sake of brevity.

The tool 10 is drawn up the borehole 14 and stopped adjacent formation intervals of interest (identified for example from other prior logging operations) as indicated by the depth signals generated by the depth gauge 22. The back-up pad 34, packer 32 and probe 30 are extended and then two successive samples are taken via the probe 30 at (typically predetermined) respective and different flow rates into the sample chambers. During the period in which fluid samples are extracted from the formation (known as 'draw-down') the fluid pressure in the probe, and therefore of the formation 16 in the immediate vicinity of the probe 32, is monitored by the pressure gauges. Likewise the pressure continues to be monitored for a period after the termination of fluid extraction, while the formation pressure relaxes back to its undisturbed value ('build-up'). Typically the build-up measurement continues for a period of the order of 200 seconds.

Electrical signals generated by the gauges and representative of the pressure are suitably conditioned by processing and interface circuitry in the tool 10 and transmitted up the cable 12 to the surface equipment 24. This equipment typically receives, decodes, amplifies and records the signals on chart and/or magnetic tape recorders as a function of time. In addition the equipment 24 may, as described below, analyze the data represented by these signals to yield permeability values which are also recorded. These and other signals from the tool 10 also enable the surface equipment 24 to monitor the operation of the tool 10 and generate signals which are transmitted down the cable 12 to control the tool 10, for example to synchronize the operation of its component mechanisms.

Other details for optimizing formation pressure measurements with the apparatus shown in FIG. 1 are well known to those skilled in this art and thus need not be repeated here.

The surface equipment 24 typically incorporates a data processor 26 for coordinating and controlling the logging operation, and this processor may also be used for analysis of the recorded pressure measurements at the wellsite. Alternatively or in addition, the recordings may be transferred to a remote location for subsequent more detailed analysis. It will be understood by those skilled in the art that this analysis can be implemented, for example, by appropriate programming of a general purpose digital computer or by means of special purpose electronic circuitry.

Conventionally the pressure measurements obtained during a logging operation such as that shown in FIG. 1 have been analyzed in two ways. The build-up measurements of pressure P are modelled as a function of time $\Delta t$ after fluid extraction has ended (shut-in) by the following equation $$P(t) = P_f + m\left[\frac{Q_2}{Q_1\sqrt{\Delta t}} - \frac{(Q_2/Q_1 - 1)}{\sqrt{\Delta t + T_2}} - \frac{1}{\sqrt{\Delta t + T_1 + T_2}}\right] \quad (2)$$

where m is defined by the expression $$m = (Q_1\mu/4\pi k_S)\sqrt{(\Phi\mu c_t/\pi k_S)} \quad (2a)$$

$P_f$ is the pressure of the undisturbed formation after build-up has finished;

$Q_1$ and $Q_2$ are the volumetric flow rates during the first and second draw-down periods;

$T_1$ and $T_2$ are the durations of the first and second draw-down periods;

$\mu$ is the dynamic viscosity of the formation fluid (typically determined by laboratory measurements of fluid samples, which may be obtained with the tool 10 itself);

$k_S$ is the spherical permeability, given by $$k_S=(k_H 2 k_V)^{\frac{1}{2}} \quad (2b)$$

$k_H$ and $k_V$ and being the horizontal and vertical formation permeabilities respectively;

$\Phi$ is the formation porosity, obtained for example by neutron, gamma ray and/or sonic logging;

$c_t$ represents the total formation compressibility ($=c_{rock}+c_{gas}S_{gas}+c_{water}S_{water}+c_{oil}S_{oil}$, where S is saturation), typically obtained by laboratory measurements of formation samples.

Thus the variation of the pressure measurements P with respect to a spherical time function $$f(\Delta t)=\frac{Q_2}{Q_1\sqrt{\Delta t}}-\frac{(Q_2/Q_1-1)}{\sqrt{\Delta t+T_2}}-\frac{1}{\sqrt{\Delta t+T_1+T_2}} \quad (2c)$$

is fitted with a straight line approximation. The slope of this line provides the value of m. Together with values of $\mu$, $\Phi$ and $c_t$, obtained as indicated above, this m value enables the spherical permeability $k_S$ to be determined.

Hitherto the draw-down measurements during fluid extraction have been modelled using the expression $$P_f-P_i=CQ_i\mu/2\pi k_S r_{pe} \text{ for } i=1,2 \quad (3)$$

where $P_i$ is the measured fluid pressure at the end of the i'th draw-down period;

C denotes the shape factor, which incorporates effects due to the presence of the borehole into the model and is usually taken as being 0.645; and $r_{pe}$ denotes the effective radius of the probe, usually taken as being $2rp/\pi$ where rp is the actual probe aperture radius.

Equation (3) can be applied both to the first (i=1) and second (i=2) draw-down samples, giving two values for $k_S$ in addition to the values obtained using equation (2a). Further details are to be found in the afore-mentioned publication 'RFT Essentials of pressure test interpretation'.

It is commonly found that the values of permeability obtained using equation (3) for draw-down may be up to an order of magnitude greater than the value obtained for the same measurement cycle from equation (2a) for build-up. This observation is of interest since it is conventional to assume that various factors perturb the draw-down measurement, during which fluid actually flows. These factors include the very limited depth of penetration of the probe 30 into the formation 16, as a result of which the probe aperture is usually located within a region of the formation that has been invaded during drilling by the borehole liquid 18 and by solid particles suspended in that liquid, with a consequent substantial alteration of the properties of that region. Another such factor is the possibility that insertion of the probe 30 damages the formation in its immediate vicinity, causing a localized change in properties. Additionally the flow pattern into the probe 30 during draw-down may itself produce perturbations of the pressure measurement. These perturbations are collectively incorporated in analyses of measurements made by the tool 10 by attributing them to a so-called 'skin effect'. However, theoretical analysis of this skin effect suggests that it would be likely to decrease the permeability value derived from draw-down measurements, in contrast to the higher value from these measurements that is obtained in practice. Hitherto it has proved difficult to reconcile the practical measurements and the theoretical model in this respect. Thus doubt has been cast on the validity of permeability values derived with the tool 10, and it has not been clear which, if either, of the draw-down and build-up values for permeability is a better indicator of the actual formation permeability. Furthermore it is conventional wisdom that measurements made with the tool 10 cannot provide information about horizontal and vertical permeabilities individually.

According to this invention, the conventional analysis of draw-down measurements incorporating equation (3) is replaced by an analysis based upon the following relationship to describe the fluid behavior during draw-down in terms of measured parameters:

$$P_f-P_i=(Q_i\mu/2\pi rp\, k_H)F[\pi/2,\sqrt{(1-k_V/k_H)}] \text{ for } i=1,2 \quad (1)$$

where $Q_i$ represents volumetric flow rate during draw-down period i; and

F denotes the complete elliptic integral of the first kind.

The inventors hereof have arrived at the relationship stated in equation (1) as a result of a new and correct analysis of the fluid dynamics in the formation in the immediate vicinity of the probe 30, in particular taking account of the effects of anisotropy. The purpose of this analysis is to evaluate the equation $$Q=+k_H/\mu\int_{A_p}\partial P/\partial y|_{y=0}dxdz \quad (4)$$

where $A_p$ denotes the surface of the probe in contact with the formation in order to arrive at an expression in terms of parameters which are directly measurable, such as flow rate Q and pressure P.

To this end the inventors have formulated the following set of relationships, which taken together constitute a mixed-boundary value problem, as being an appropriate description of the fluid dynamics in the vicinity of the probe 30 during draw-down:

$$k_V\partial^2P/\partial z^2+k_H[\partial^2P/\partial x^2+\partial^2P/\partial y^2]=0$$

$$P=P_P \text{ for } x^2+z^2\leqq rp^2 \text{ and } y=0 \quad (5)$$

$$\partial P/\partial y=0 \text{ for } x^2+z^2\geqq rp^2 \text{ and } y=0$$

$$P\rightarrow P_f \text{ as } x^2+y^2+z^2\rightarrow\infty \text{ and } y\geqq 0$$

where $P_P$ denotes the pressure at the probe;

the surface y=0 denotes the wall of the wellbore and the formation is located at y>0;

$k_H$ denotes the formation permeabilities in the x and y directions; and $k_V$ denotes the formation permeability in the z direction.

It is believed that this is the first time that fluid behavior during extraction using an arrangement such as that shown in FIG. 1 has been formulated in terms of a mixed-boundary value problem of the form of (5).

The inventors hereof have found a relationship which is derived from an expression satisfying (5), and which is equivalent to (4) for the case of an arbitrary function for the pressure $P_P$ at the probe. This relationship for the specific case of $P_P$ being a constant across the probe is $$\mu Q/k_H(P_f-P_P)=(rp/F[\pi/2,\sqrt{(1-k_V/k_H)}])\int\int_{A_p}1/\sqrt{(1-x^2/rp^2-z^2/rp^2)}d(z/rp)d(x/rp) \quad (6)$$

Evaluation of equation (6) yields equation (1), which constitutes the desired description of the fluid dynamics during draw-down in terms of measurable parameters including flow rate Q and pressure P.

Figure 2:
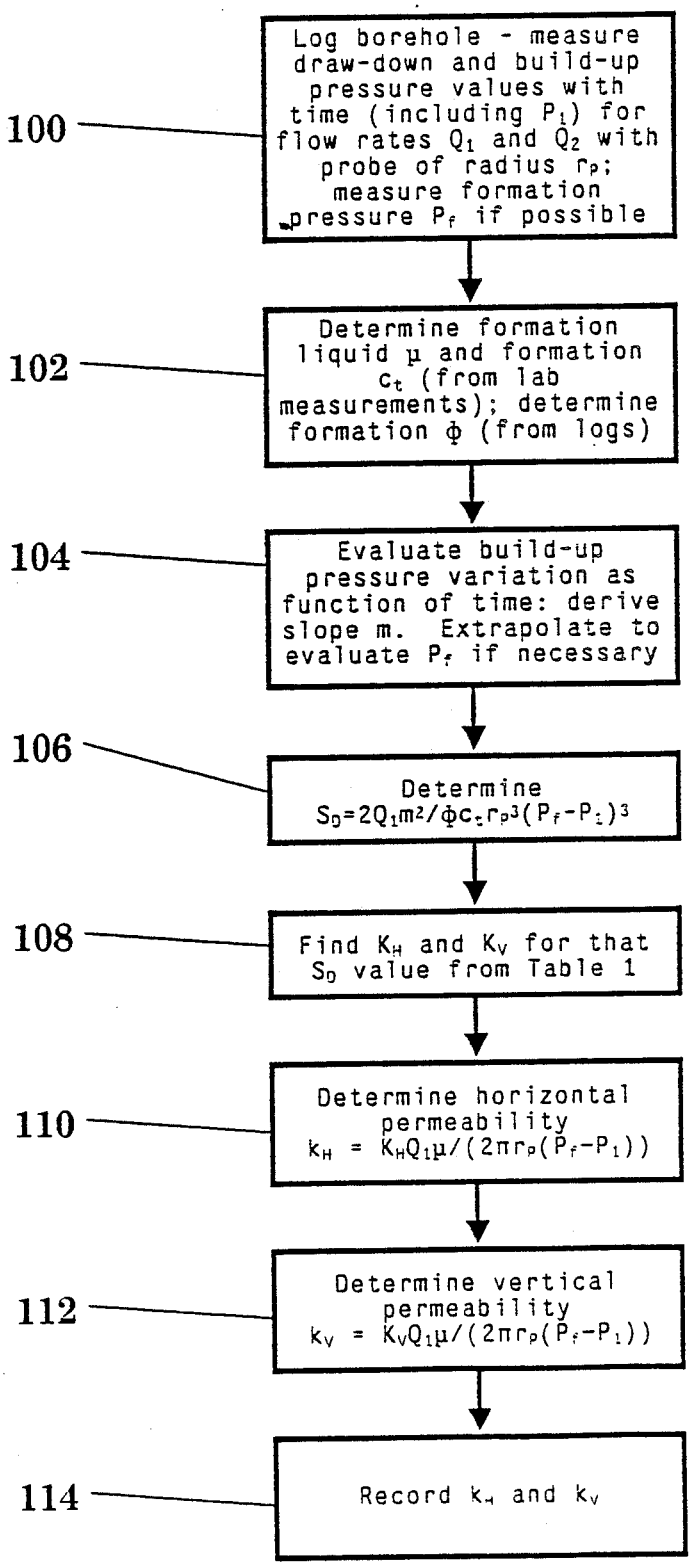
FIG. 2 shows a flow diagram of a method for permeability determination in accordance with this invention.

FIG. 2 shows one practical approach to incorporating the relationship given by equation (1) into an analysis of measurements made with the apparatus of FIG. 1. This approach takes cognizance of the difficulty of implementing an analytical solution of equation (1) in a cost-effective manner with presently available technology. Accordingly equations (1), (2a) and (2b) for draw-down and build-up are evaluated in advance for a range of possible formation conditions, and the results tabulated. The results corresponding to the conditions observed for a set of actual measurements are then extracted and applied in the analysis of those measurements.

To this end, equations (1) (with i=1), (2a) and (2b) are rewritten and combined into the forms $$K_H=F[\pi/2,\sqrt{(1-1/S_DK_{H3})}] \quad (7)$$

$$K_V=1/S_DK_{H2} \quad (8)$$

where the dimensionless variables $K_H$, $K_V$ and $S_D$ are defined as $$K_H=k_H2\pi rp(P_f-P_1)/Q_1\mu \quad (9)$$

$$K_V=k_V2\pi rp(P_f-P_1)/Q_1\mu \quad (10)$$

$$S_D=2Q_1m^2/\Phi c_t rp^3(P_f-P_1)^3 \quad (11)$$

and the probe radius rp is assumed to be less than 0.05 the radius of the borehole 14. Simultaneous equations (7) and (8) have been evaluated for a range of values of the anisotropy $k_H/k_V$ from 1:1 up to 150:1 and the corresponding values of $S_D$ are given in Table 1 (FIGS. 3*a* to 3*c*).

Inspection of Table 1 shows that for each value of anisotropy $k_H/k_V(=K_H/K_V)$ there is a corresponding pair of values of the dimensionless variables $K_H$ and $K_V$. It should be noted that this does not imply that for each value of anisotropy $k_H/k_V$ there is also a single corresponding pair of values of the permeabilities $k_H$ and $k_V$, since these values are related not only to $K_H$ and $K_V$ but also to rp, $P_f$, $P_1$, $Q_1$ and $\mu$. The inventors hereof have found that except for a very limited range of values of anisotropy ($1\leqq k_H/k_V<3.373$) there is also a one-to-one correspondence between $S_D$ and anisotropy $k_H/k_V$. For anisotropy in the range $1\leqq k_H/k_V<3.373$, that is $S_D\leqq 0.258012$, there are two possible values of anisotropy for each value of $S_D$. However, a formation with an anisotropy as low as either of these values can typically be considered as being effectively isotropic for most practical purposes, so in these circumstances the exact anisotropy is not significant.

Referring to FIG. 2, the first step 100 in the procedure illustrated therein involves operating the apparatus described above with reference to FIG. 1 to obtain measurements of formation pressure during and after draw-down of fluids at flow rates $Q_1$ and $Q_2$. These measurements specifically include the pressure $P_1$ at the end of draw-down at flow-rate $Q_1$. If the formation permeability is high enough for the build-up pressure variation to reach an asymptotic value during the build-up measurement, then the undisturbed formation pressure $P_f$ at the end of build-up can also be determined in step 100.

At step 102 the values for total formation compressibility $c_t$ and formation fluid dynamic viscosity $\mu$ are obtained, for example from the results of laboratory measurements of samples of the formation and of the formation fluid taken in the borehole 14, or from measurements of samples taken elsewhere and considered to be representative of the conditions in the vicinity of the borehole 14. Likewise the value of the formation porosity $\Phi$ is obtained, for example from neutron, gamma ray and/or sonic logging in the borehole 14 or in a comparable borehole.

At step 104, the build-up pressure measurements taken at step 100 are used in conjunction with equation (2) above in known manner to derive a value for m, the slope of the variation of build-up pressure with respect to the spherical time function (2*c*). In the case where low formation permeability precludes direct measurement of the undisturbed formation pressure $P_f$ at step 100, a value for $P_f$ may be obtained at step 104 by extrapolation of the variation of build-up pressure with respect to the spherical time function.

The value of m is then combined at step 106 with the first draw-down flowrate $Q_1$, the probe radius rp, the formation pressure values $P_f$ and $P_1$ and the values for $c_t$ and $\Phi$ to derive a value for the dimensionless constant $S_D$ according to equivalence (11) above.

The value for $S_D$ found at step 106 is used in step 108 to extract corresponding values for $K_H$ and $K_V$ from Table 1, and these values are used at steps 110 and 112 to derive values for the horizontal permeability $k_H$ and the vertical permeability $k_V$ respectively, using the following rearrangements of equivalences (9) and (10) above:

$$k_H=K_HQ_1\mu/(2\pi rp(P_f-P_1))$$

$$k_V=K_VQ_1\mu/(2\pi rp(P_f-P_1))$$

Finally at step 114 the derived values of $k_H$ and $k_V$ are recorded, for example as a function of the depth to which they relate.

As noted above, for values of $S_D\leqq 0.258012$ (corresponding to an anisotropy between 1 and 3.373) there are two possible values of anisotropy and therefore of $K_H$ and $K_V$ and of $k_H$ and $k_V$. In these circumstances both possible values may be given, with an indication of the ambiguity. In practice the formation properties for either value of anisotropy will be sufficiently similar, and sufficiently close to isotropy, that the choice of value is of little significance.

By way of example, a hypothetical set of measurements will be considered in which formation pressure variation with time indicates that $P_f=2.068\times10^7$ Pa (3000 psi) and $P_1=9.454\times10^6$ Pa (1371 psi) for $Q_1=1$ $cm^3/s$ and rp=0.5 cm. Borehole liquid and formation parameters will be taken as being $\mu=0.01$ poise, $c_t=45\times10-^{11}$ $m^2/N$ and $\Phi=0.2$. Plotting the variation of pressure during build-up as a function of the spherical time function (2*c*) will be taken as yielding a value for m, the slope of the best straight line approximation, of $5.43\times10^4$ Pa.s$^{\frac{1}{2}}$ (7.87 psi.s$^{\frac{1}{2}}$). Equivalence (11) provides a value for $S_D=0.37$, which from Table 1 gives $K_H=2.79$ and $K_V=0.348$. Therefore, applying equivalences (9) and (10) respectively, the horizontal permeability $k_H=7.9\times10^{-11}$ cm$^2$ (8 millidarcy) and the vertical permeability $k_V=9.87\times10^{-12}$ cm$^2$ (1 millidarcy).

It is sometimes found that while values for the pressures $P_1$ and $P_2$ at the end of draw-down can be obtained with acceptable accuracy, the variation of pressure with time during build-up (needed to find the slope m of that variation) cannot be measured sufficiently well to provide reliable results. This typically occurs in highly permeable formations (e.g. $k_H>9.87\times10^{-11}$ cm$^2$; $k_H>10$ millidarcy) through which fluid can therefore flow readily, so that the pressure relaxes back to its undisturbed value too quickly for sufficient measurements to be made to characterize properly the variation of pressure with time. Since m is therefore unknown equivalence (11) cannot be used to derive a value for $S_D$. Nonetheless it is possible with the present invention to identify plausible ranges for the values of horizontal and vertical permeability, provided a range of values for the anisotropy $k_H/k_V$ is available.

Thus, while it may not be possible to derive the slope m it may be possible to estimate the anisotropy as being in the range $1\leqq k_H/k_V\leqq10$, for example, based on other knowledge of the formation 16. As noted earlier, the inventors hereof have found that for each value of anisotropy there is a single corresponding pair of values for the dimensionless parameters $K_H$ and $K_V$. Consequently the estimated range of anisotropy can be used in combination with Table 1 to identify a range of likely values for each of these parameters $K_H$ and $K_V$ and thus for the horizontal and vertical permeabilities $k_H$ and $k_V$, as shown in FIG. 4.

Figure 4:
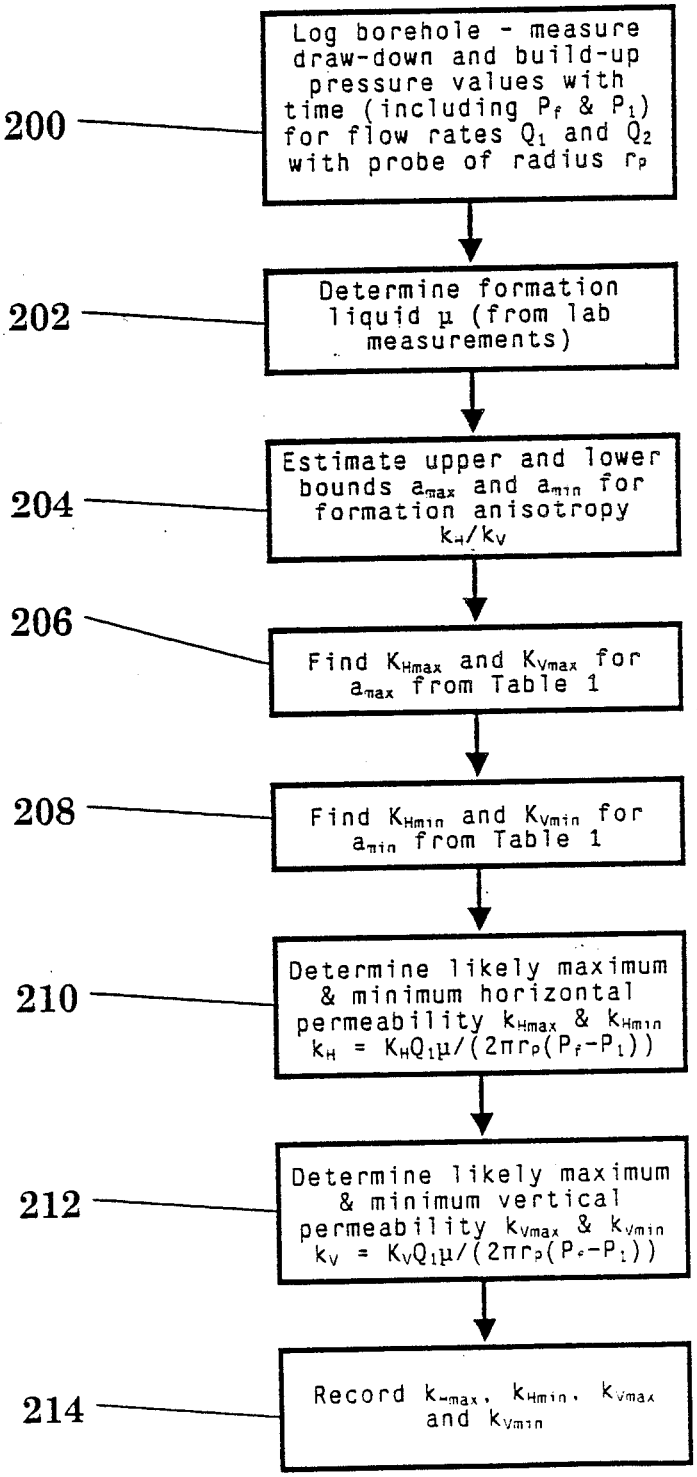
FIG. 4 shows a flow diagram of a method for estimating likely permeability range in accordance with this invention.

Referring to FIG. 4, measurements of formation pressure during and after draw-down of fluids at flow rates $Q_1$ and $Q_2$ are obtained at step 200, in a manner similar to that of step 100 in FIG. 2. These measurements specifically include the pressure $P_1$ at the end of draw-down at flow-rate $Q_1$ and the undisturbed formation pressure $P_f$ at the end of build-up. Since it is envisaged that the procedure of FIG. 4 will usually be used in cases where the formation permeability is relatively high, the build-up pressure variation can be expected to reach an asymptotic value during the build-up measurement, so the undisturbed formation pressure $P_f$ can be determined.

At step 202 a value for formation fluid dynamic viscosity $\mu$ is obtained as at step 102 of FIG. 2. At step 204, the maximum and minimum likely values $a_{max}$ and $a_{min}$ for formation anisotropy $k_H/k_V$ are estimated, for example from measurements of core samples or based on knowledge of the geology of the formation 16.

These values of anisotropy are then used in steps 206 and 208 to extract corresponding maximum and minimum values for $K_H$ and $K_V$ from Table 1. These pairs of values $K_{Hmax}$, $K_{Hmin}$ and $K_{Vmax}$, $K_{Vmin}$ are used at steps 210 and 212 respectively to derive likely maximum and minimum values $k_{Hmax}$, $k_{Hmin}$ for the horizontal permeability and $k_{Vmax}$, $k_{Vmin}$ for the vertical permeability respectively, using the same expressions as at steps 110 and 112 of FIG. 2. Finally at step 214 these derived maximum and minimum values of $k_H$ and $k_V$ are recorded.

Thus, using the same values as in the above numerical example, together with an estimated formation anisotropy range of $1\leqq k_H/k_V\leqq10$, inspection of Table 1 provides likely limits for $K_H$ and $K_V$ of $1.57\leqq K_H\leqq2.90$ and $0.29\leqq K_V\leqq1.57$. Therefore likely upper and lower bounds for the horizontal and vertical permeabilities may be estimated from equivalences (9) and (10) as $4.45\times10^{-11}\leqq k_H\leqq8.22\times^{-11}$ cm$^2$ ($4.51\leqq k_H\leqq8.33$ millidarcy) and $8.22\times10^{-12}\leqq k_V\leqq4.45\times10^{-11}$ cm$^2$ ($0.833\leqq k_V\leqq4.51$ millidarcy).

There has been described and illustrated herein methods in accordance with the present invention for determining the horizontal and/or vertical permeability of an earth formation, using measurements from a borehole logging tool having a single probe. While particular embodiments of the invention have been described, it is not intended that the invention be limited thereby. Thus, for example, equivalences (9) through (11) have been expressed in terms of the values $P_1$ and $Q_1$ during the first draw-down of fluid. Clearly they may also be expressed in terms of the values $P_2$ and $Q_2$ for the second draw-down. Therefore it will be apparent to those skilled in the art that various changes and modifications may be made to the invention as described without departing from the spirit and scope of the appended claims.

We claim:

1. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

recording the build-up pressure of the fluid in the formation over a third time period, the pressure measured substantially at the end of said third time period being $P_f$;

calculating a first factor m which correlates a predetermined pressure build-up model to said recorded build-up pressure;

calculating a second factor $S_D$ based on said flow rate $Q_1$, pressure $P_1$, probe radius $r_p$, pressure $P_f$ and first factor m;

calculating a dimensionless quantity $K_H$, representative of the horizontal permeability of the formation, based on said second factor $S_D$; and calculating a horizontal permeability $k_H$ of the formation based on said quantity $K_H$, probe radius $r_p$ and pressure $P_f$.

2. The method of claim 1, said method of calculating said quantity $k_H$ is based on the following equation:

$$k_H = \frac{K_H Q_1 \mu}{2\pi r_p (P_f - P_1)}$$

where $\mu$ represents the dynamic viscosity of the fluid.

3. The method of claim 1, wherein said step of calculating said dimensionless quantity $K_H$ is based on second factor $S_D$ and Table 1, wherein said value of $K_H$ is determined by interpolation, where necessary.

4. The method of claim 1, said method further comprising the steps of:

calculating a dimensionless quantity $K_V$, representative of the vertical permeability of the formation, based on said second factor $S_D$; and calculating a vertical permeability $k_V$ of the formation based on said quantity $K_V$, probe radius $r_p$ and pressure $P_f$.

5. The method of claim 4, said method of calculating said quantity $k_V$ is based on the following equation:

$$k_v = \frac{K_v Q_1 \mu}{2\pi r_p (P_f - P_1)}$$

where $\mu$ represents the dynamic viscosity of the fluid.

6. The method of claim 4, wherein said step of calculating said dimensionless quantity $K_V$ is based on second factor $S_D$ and Table 1, wherein said value of $K_V$ is determined by interpolation, where necessary.

7. The method of claim 4, wherein the steps of calculating said dimensionless quantities $K_H$ and $K_V$ are by solving two simultaneous equations, said simultaneous equations based on the following two simultaneous equations:

$$K_H = F\left[\frac{\pi}{2}, \sqrt{1 \frac{1}{S_D K_H^3}}\right]$$

$$K_v = \frac{1}{S_D K_H^2}$$

where F denotes the complete elliptic integral of the first kind.

8. The method of claim 1, wherein said step of calculating said first factor m is based on the following equation:

$$P(t) = P_f +$$

$$m\left[\frac{Q_2}{Q_1\sqrt{\Delta t}} - \frac{(Q_2/Q_1 - 1)}{\sqrt{\Delta t + T_2}} - \frac{1}{\sqrt{\Delta t + T_1 + T_2}}\right]$$

where

P(t) represents the recorded build-up pressure of the fluid in the formation; and $\Delta t$ represents the instantaneous time in said third time period.

9. The method of claim 1, wherein said step of calculating said second factor $S_D$ is based on the following equation:

$$S_D = \frac{2Q_1 m^2}{\Phi c_t r p^3 (P_f - P_1)^3}$$

where $\phi$ represents the formation bulk porosity; and $c_t$ represents the total compressibility.

10. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

recording the build-up pressure of the fluid in the formation over a third time period, the pressure measured substantially at the end of said third time period being $P_f$;

calculating a first factor m which correlates a predetermined pressure build-up model to said recorded build-up pressure;

calculating a second factor $S_D$ based on said flow rate $Q_1$, pressure $P_1$, probe radius $r_p$, pressure $P_f$ and first factor m;

calculating a dimensionless quantity $K_V$, representative of the vertical permeability of the formation, based on said second factor $S_D$; and calculating a vertical permeability $k_V$ of the formation based on said quantity $K_V$, probe radius $r_p$ and pressure $P_f$.

11. The method of claim 10, said method of calculating said quantity $k_V$ is based on the following equation:

$$k_v = \frac{K_v Q_1 \mu}{2\pi r_p (P_f - P_1)}$$

where $\mu$ represents the dynamic viscosity of the fluid.

12. The method of claim 10, wherein said step of calculating said dimensionless quantity $K_V$ is based on second factor $S_D$ and Table 1, wherein said value of $K_V$ is determined by interpolation, where necessary.

13. The method of claim 10, said method further comprising the steps of:

calculating a dimensionless quantity $K_H$, representative of the horizontal permeability of the formation, based on said second factor $S_D$; and calculating a horizontal permeability $k_H$ of the formation based on said quantity $K_H$, probe radius $r_p$ and pressure $P_f$.

14. The method of claim 13, said method of calculating said quantity $k_H$ is based on the following equation:

$$k_H = \frac{K_H Q_1 \mu}{2\pi r_p (P_f - P_1)}$$

where $\mu$ represents the dynamic viscosity of the fluid.

15. The method of claim 13, wherein said step of calculating said dimensionless quantity $K_H$ is based on second factor $S_D$ and Table 1, wherein said value of $K_H$ is determined by interpolation, where necessary.

16. The method of claim 13, wherein the steps of calculating said dimensionless quantities $K_H$ and $K_V$ are by solving two simultaneous equations, said simultaneous equations based on the following two simultaneous equations:

$$K_H = F\left[\frac{\pi}{2}, \sqrt{1 \frac{1}{S_D K_H^3}}\right]$$

$$K_v = \frac{1}{S_D K_H^2}$$

where F denotes the complete elliptic integral of the first kind.

17. The method of claim 10, wherein said step of calculating said first factor m is based on the following equation:

$$P(t) = P_f +$$

-continued $$m\left[\frac{Q_2}{Q_1\sqrt{\Delta t}} - \frac{(Q_2/Q_1 - 1)}{\sqrt{\Delta t + T_2}} - \frac{1}{\sqrt{\Delta t + T_1 + T_2}}\right]$$

where

P(t) represents the recorded build-up pressure of the fluid in the formation; and $\Delta t$ represents the instantaneous time in said third time period.

18. The method of claim 10, wherein said step of calculating said second factor $S_D$ is based on the following equation:

$$S_D = \frac{2Q_1m^2}{\Phi c_t r_p^3(P_f - P_1)^3}$$

where $\phi$ represents the formation bulk porosity; and $c_t$ represents the total compressibility.

19. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

recording the build-up pressure of the fluid in the formation over a second time period, the pressure measured substantially at the end of said second time period being $P_f$;

calculating a first factor m which correlates a predetermined pressure build-up model to said recorded build-up pressure;

calculating a second factor $S_D$ based on said flow rate $Q_1$, pressure $P_1$, probe radius $r_p$, pressure $P_f$ and first factor m;

calculating a dimensionless quantity $K_H$, representative of the horizontal permeability of the formation, based on said second factor $S_D$; and calculating a horizontal permeability $k_H$ of the formation based on said quantity $K_H$, probe radius $r_p$ and pressure $P_f$.

20. The method of claim 19, said method of calculating said quantity $k_H$ is based on the following equation:

$$k_H = \frac{K_H Q_1 \mu}{2\pi r_p(P_f - P_1)}$$

where $\mu$ represents the dynamic viscosity of the fluid.

21. The method of claim 19, wherein said step of calculating said dimensionless quantity $K_H$ is based on second factor $S_D$ and Table 1, wherein said value of $K_H$ is determined by interpolation, where necessary.

22. The method of claim 19, said method further comprising the steps of:

calculating a dimensionless quantity $K_V$, representative of the vertical permeability of the formation, based on said second factor $S_D$; and calculating a vertical permeability $k_V$ of the formation based on said quantity $K_V$, probe radius $r_p$ and pressure $P_f$.

23. The method of claim 22, said method of calculating said quantity $k_V$ is based on the following equation:

$$k_v = \frac{K_v Q_1 \mu}{2\pi r_p(P_f - P_1)}$$

where $\mu$ represents the dynamic viscosity of the fluid.

24. The method of claim 22, wherein said step of calculating said dimensionless quantity $K_V$ is based on second factor $S_D$ and Table 1, wherein said value of $K_V$ is determined by interpolation, where necessary.

25. The method of claim 22, wherein the steps of calculating said dimensionless quantities $K_H$ and $K_V$ are by solving two simultaneous equations, said simultaneous equations based on the following two simultaneous equations:

$$K_H = F\left[\frac{\pi}{2}, \sqrt{1\frac{1}{S_D K_H^3}}\right]$$

$$K_v = \frac{1}{S_D K_H^2}$$

where F denotes the complete elliptic integral of the first kind.

26. The method of claim 19, wherein said step of calculating said first factor m is based on the following equation:

$$P(t) = P_f + m\left[\frac{1}{\sqrt{\Delta t}} - \frac{1}{\sqrt{\Delta t + T_1}}\right]$$

where

P(t) represents the recorded build-up pressure of the fluid in the formation; and $\Delta t$ represents the instantaneous time in said third time period.

27. The method of claim 19, wherein said step of calculating said second factor $S_D$ is based on the following equation:

$$S_D = \frac{2Q_1m^2}{\Phi c_t r_p^3(P_f - P_1)^3}$$

where $\phi$ represents the formation bulk porosity; and $c_t$ represents the total compressibility.

28. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

recording the build-up pressure of the fluid in the formation over a second time period, the pressure measured substantially at the end of said second time period being $P_f$;

calculating a first factor m which correlates a predetermined pressure build-up model to said recorded build-up pressure;

calculating a second factor $S_D$ based on said flow rate $Q_1$, pressure $P_1$, probe radius $r_p$, pressure $P_f$ and first factor m;

calculating a dimensionless quantity $K_V$, representative of the vertical permeability of the formation, based on said second factor $S_D$; and calculating a vertical permeability $k_V$ of the formation based on said quantity $K_V$, probe radius $r_p$ and pressure $P_f$.

29. The method of claim 28, said method of calculating said quantity $k_V$ is based on the following equation:

$$k_v = \frac{K_v Q_1 \mu}{2\pi r_p (P_f - P_1)}$$

where $\mu$ represents the dynamic viscosity of the fluid.

30. The method of claim 28, wherein said step of calculating said dimensionless quantity $K_V$ is based on second factor $S_D$ and Table 1, wherein said value of $K_V$ is determined by interpolation, where necessary.

31. The method of claim 28, said method further comprising the steps of:

calculating a dimensionless quantity $K_H$, representative of the horizontal permeability of the formation, based on said second factor $S_D$; and calculating a horizontal permeability $k_H$ of the formation based on said quantity $K_H$, probe radius $r_p$ and pressure $P_f$.

32. The method of claim 31, said method of calculating said quantity $k_H$ is based on the following equation:

$$k_H = \frac{K_H Q_1 \mu}{2\pi r_p (P_f - P_1)}$$

where $\mu$ represents the dynamic viscosity of the fluid.

33. The method of claim 31, wherein said step of calculating said dimensionless quantity $K_H$ is based on second factor $S_D$ and Table 1, wherein said value of $K_H$ is determined by interpolation, where necessary.

34. The method of claim 31, wherein the steps of calculating said dimensionless quantities $K_H$ and $K_V$ are by solving two simultaneous equations, said simultaneous equations based on the following two simultaneous equations:

$$K_H = F\left[\frac{\pi}{2}, \sqrt{1 \frac{1}{S_D K_H^3}}\right]$$

$$K_v = \frac{1}{S_D K_H^2}$$

where F denotes the complete elliptic integral of the first kind.

35. The method of claim 28, wherein said step of calculating said first factor m is based on the following equation:

$$P(t) = P_f + m\left[\frac{1}{\sqrt{\Delta t}} - \frac{1}{\sqrt{\Delta t + T_1}}\right]$$

where

P(t) represents the recorded build-up pressure of the fluid in the formation; and $\Delta t$ represents the instantaneous time in said third time period.

36. The method of claim 28, wherein said step of calculating said second factor $S_D$ is based on the following equation:

$$S_D = \frac{2Q_1 m^2}{\Phi c_t r p^3 (P_f - P_1)^3}$$

where $\phi$ represents the formation bulk porosity; and $c_t$ represents the total compressibility.

37. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

allowing the pressure of the fluid in the formation to build-up over a third time period, the pressure measured substantially at the end of said third time period being $P_f$;

estimating a value of formation anisotropy, said anisotropy being the ratio of horizontal permeability $k_H$ and vertical permeability $k_V$; and determining a value of horizontal permeability $k_H$ based on first rate $Q_1$, radius $r_p$, said estimated value of formation anisotropy, and pressures $P_1$ and $P_f$.

38. The method of claim 37, said method further comprising the step of:

determining a value of vertical permeability $k_V$ based on said estimated value of formation anisotropy.

39. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

allowing the pressure of the fluid in the formation to build-up over a third time period, the pressure measured substantially at the end of said third time period being $P_f$;

estimating a value of formation anisotropy, said anisotropy being the ratio of horizontal permeability $k_H$ and vertical permeability $k_V$; and determining a value of vertical permeability $k_V$ based on first rate $Q_1$, radius $r_p$, said estimated value of formation anisotropy, and pressures $P_1$ and $P_f$.

40. The method of claim 39, said method further comprising the step of:

determining a value of horizontal permeability $k_H$ based on said estimated value of formation anisotropy.

41. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

allowing the pressure of the fluid in the formation to build-up over a third time period, the pressure measured substantially at the end of said third time period being $P_f$;

estimating a value of formation anisotropy, said anisotropy being the ratio of horizontal permeability $k_H$ and vertical permeability $k_V$;

determining a value of factor $K_H$ based on said estimated value of formation anisotropy and Table 1; and determining a value of horizontal permeability $k_H$ based on first rate $Q_1$, radius $r_p$, factor $K_H$, and pressures $P_1$ and $P_f$.

42. The method of claim 41, said method further comprising the step of:

determining a value of vertical permeability $k_V$ based on said estimated value of formation anisotropy.

43. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

drawing a fluid from the formation at a second rate $Q_2$ through said probe for a second time period $T_2$;

measuring a pressure $P_2$ of the fluid substantially at the end of said second time period;

allowing the pressure of the fluid in the formation to build-up over a third time period, the pressure measured substantially at the end of said third time period being $P_f$;

estimating a value of formation anisotropy, said anisotropy being the ratio of horizontal permeability $k_H$ and vertical permeability $k_V$;

determining a value of factor $K_V$ based on said estimated value of formation anisotropy and Table 1; and determining a value of vertical permeability $k_V$ based on first rate $Q_1$, radius $r_p$, factor $K_V$, and pressures $P_1$ and $P_f$.

44. The method of claim 43, said method further comprising the step of:

determining a value of horizontal permeability $k_H$ based on said estimated value of formation anisotropy.

45. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

allowing the pressure of the fluid in the formation to build-up over a second time period, the pressure measured substantially at the end of said second time period being $P_f$;

estimating a value of formation anisotropy, said anisotropy being the ratio of horizontal permeability $k_H$ and vertical permeability $k_V$; and determining a value of horizontal permeability $k_H$ based on first rate $Q_1$, radius $r_p$, said estimated value of formation anisotropy, and pressures $P_1$ and $P_f$.

46. The method of claim 45, said method further comprising the step of:

determining a value of vertical permeability $k_V$ based on said estimated value of formation anisotropy.

47. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

allowing the pressure of the fluid in the formation to build-up over a second time period, the pressure measured substantially at the end of said second time period being $P_f$;

estimating a value of formation anisotropy, said anisotropy being the ratio of horizontal permeability $k_H$ and vertical permeability $k_V$; and determining a value of vertical permeability $k_V$ based on first rate $Q_1$, radius $r_p$, said estimated value of formation anisotropy, and pressures $P_1$ and $P_f$.

48. The method of claim 47, said method further comprising the step of:

determining a value of horizontal permeability $k_H$ based on said estimated value of formation anisotropy.

49. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

allowing the pressure of the fluid in the formation to build-up over a second time period, the pressure measured substantially at the end of said second time period being $P_f$;

estimating a value of formation anisotropy, said anisotropy being the ratio of horizontal permeability $k_H$ and vertical permeability $k_V$;

determining a value of factor $K_H$ based on said estimated value of formation anisotropy and Table 1; and determining a value of horizontal permeability $k_H$ based on first rate $Q_1$, radius $r_p$, factor $K_H$, and pressures $P_1$ and $P_f$.

50. The method of claim 49, said method further comprising the step of:

determining a value of vertical permeability $k_V$ based on said estimated value of formation anisotropy.

51. A method of estimating horizontal and/or vertical permeability of a formation traversing a borehole, said method comprising the steps of:

drawing fluid from the formation at a first rate $Q_1$ through a probe having a radius $r_p$ for a first time period $T_1$;

measuring a pressure $P_1$ of the fluid substantially at the end of said first time period;

allowing the pressure of the fluid in the formation to build-up over a second time period, the pressure measured substantially at the end of said second time period being $P_f$;

estimating a value of formation anisotropy, said anisotropy being the ratio of horizontal permeability $k_H$ and vertical permeability $k_V$;

determining a value of factor $K_V$ based on said estimated value of formation anisotropy and Table 1; and determining a value of vertical permeability $k_V$ based on first rate $Q_1$, radius $r_p$, factor $K_V$, and pressures $P_1$ and $P_f$.

52. The method of claim 51, said method further comprising the step of:

determining a value of horizontal permeability $k_H$ based on said estimated value of formation anisotropy.

* * * * *